US009091261B2

(12) United States Patent
Bear et al.

(10) Patent No.: US 9,091,261 B2
(45) Date of Patent: Jul. 28, 2015

(54) DRY RUN PORTING SYSTEM

(75) Inventors: Patrick A. Bear, Richfield, MN (US); Matthew A. Cottrell, Woodbury, MN (US)

(73) Assignee: Pentair Flow Technologies, LLC, Delavan, WI (US)

( * ) Notice: Subject to any disclaimer, the term of this patent is extended or adjusted under 35 U.S.C. 154(b) by 1024 days.

(21) Appl. No.: 12/853,194

(22) Filed: Aug. 9, 2010

(65) Prior Publication Data

US 2011/0030822 A1 Feb. 10, 2011

Related U.S. Application Data

(60) Provisional application No. 61/232,268, filed on Aug. 7, 2009.

(51) Int. Cl.

| | |
|---|---|
| ***F04B 39/00*** | (2006.01) |
| ***F04B 49/02*** | (2006.01) |
| ***F04B 49/10*** | (2006.01) |
| ***F04B 53/08*** | (2006.01) |
| ***F04D 9/00*** | (2006.01) |
| ***F04D 9/02*** | (2006.01) |

(52) U.S. Cl.

CPC ..... *F04B 49/02* (2013.01); *F04B 49/10* (2013.01); *F04B 53/08* (2013.01); *F04D 9/007* (2013.01); *F04D 9/02* (2013.01)

(58) Field of Classification Search

USPC ..... 415/56.1–56.6; 417/119.2, 200, 417/279–311, 199.2, 542

See application file for complete search history.

(56) References Cited

U.S. PATENT DOCUMENTS

| | | | | | |
|---|---|---|---|---|---|
| 1,215,881 | A | * | 2/1917 | Siemen | 415/169.1 |
| 1,981,025 | A | * | 11/1934 | Bird | 415/56.1 |
| 2,336,580 | A | | 12/1943 | Yeatman | |
| 2,455,194 | A | | 11/1948 | Rumsey | |
| 2,664,050 | A | | 12/1953 | Abresch | |
| 2,832,293 | A | | 4/1958 | Adams et al. | |
| 2,855,857 | A | | 10/1958 | Chien-Bor Sung | |
| 2,882,830 | A | | 4/1959 | McDuffie | |
| 2,903,991 | A | | 9/1959 | Carlson et al. | |
| 3,041,979 | A | | 7/1962 | McLean et al. | |
| 3,161,135 | A | | 12/1964 | Eriksson | |
| 3,266,428 | A | * | 8/1966 | Feith et al. | 415/56.1 |
| 3,386,386 | A | | 6/1968 | Eriksson | |
| 3,664,440 | A | * | 5/1972 | Elenburg | 175/206 |
| 3,904,739 | A | * | 9/1975 | Uehara et al. | 423/400 |
| 4,392,779 | A | | 7/1983 | Bloemers et al. | |
| 5,114,318 | A | * | 5/1992 | Freeborn | 417/379 |
| 5,366,351 | A | | 11/1994 | Nolte | |
| 5,449,280 | A | | 9/1995 | Maki et al. | |
| 5,599,171 | A | * | 2/1997 | Horwitz | 417/199.2 |

(Continued)

*Primary Examiner* — Nathaniel Wiehe
*Assistant Examiner* — Brian O Peters
(74) *Attorney, Agent, or Firm* — Quarles & Brady LLP

(57) ABSTRACT

Embodiments of the invention provide a pump including an inlet port, an outlet port, a pumping chamber, and a porting system. The porting system includes an inlet tube including a trap in which a first volume of fluid can be collected. The porting system includes a reservoir with a first chamber and a second chamber separated by a partial port wall. The second chamber receives fluid directed over the partial port wall from the pumping chamber. The reservoir collects a second volume of fluid substantially equal to the first volume of fluid. The first volume of fluid and second volume of fluid provide enough fluid trapped inside the pump to allow the pump to temporarily operate when substantially no fluid is flowing into the inlet port.

23 Claims, 5 Drawing Sheets

(56) References Cited

U.S. PATENT DOCUMENTS

| | | | | |
|---|---|---|---|---|
| 6,036,453 | A | 3/2000 | Zepp et al. | |
| 6,116,855 | A | 9/2000 | Maki | |
| 6,264,440 | B1 * | 7/2001 | Klein et al. | 417/420 |
| 6,386,835 | B1 | 5/2002 | Kalpakoff | |
| 6,398,522 | B2 | 6/2002 | Skill | |
| 6,510,890 | B1 * | 1/2003 | Paskach et al. | 165/61 |
| 6,619,938 | B2 | 9/2003 | Woodruff | |
| 2003/0165380 | A1 * | 9/2003 | Kanbara | 415/56.1 |

* cited by examiner

DRY RUN PORTING SYSTEM

RELATED APPLICATIONS

This application claims priority under 35 U.S.C. §119 to U.S. Provisional Patent Application No. 61/232,268 filed on Aug. 7, 2009, the entire contents of which is incorporated herein by reference.

BACKGROUND

Impeller pumps typically include an impeller positioned in a pumping chamber. The impeller contacts the pumping chamber and friction creates heat. Constant water flow is typically required to cool the impeller pumps in order to prevent damage to the impeller and the pumping chamber.

To increase the time period during which impeller pumps can run without water flow, prior art pumps have included impellers constructed from heat-resistant materials. However, the heat-resistant materials can reduce the efficiency of the pump. Other designs have reduced the friction created by the impeller. The higher temperatures the impeller pumps are exposed to can increase mechanical stress on other components, especially seals.

SUMMARY OF THE INVENTION

Embodiments of the invention provide a pump including an inlet port, an outlet port, a pumping chamber positioned between the inlet port and the outlet port, and a porting system. The porting system includes an inlet tube in fluid communication with the inlet port. The inlet tube includes a trap in which a first volume of fluid can be collected. The porting system includes an outlet tube in communication with the outlet port. The outlet tube includes a fill hole for use in priming the pump. The porting system includes a reservoir in fluid communication with the pumping chamber. The reservoir includes a first chamber and a second chamber separated by a partial port wall. The first chamber is in fluid communication with the outlet tube. The second chamber receives fluid directed over the partial port wall from the pumping chamber. The reservoir collects a second volume of fluid substantially equal to the first volume of fluid collected by the trap. The reservoir includes an outlet that returns excess fluid to the pumping chamber. The first volume of fluid and second volume of fluid provide enough fluid trapped inside the pump to allow the pump to temporarily operate when substantially no fluid is flowing into the inlet port.

DETAILED DESCRIPTION

Figure 2:
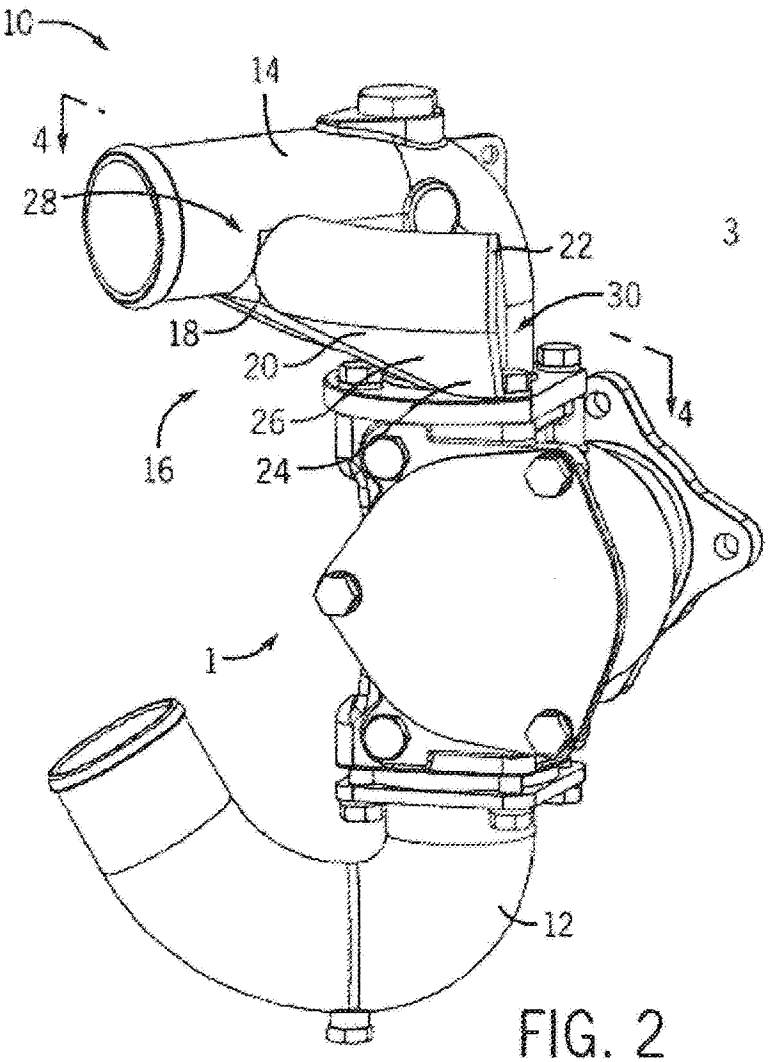
FIG. 2 is a back perspective view of the impeller pump of FIG. 1.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Figure 1:
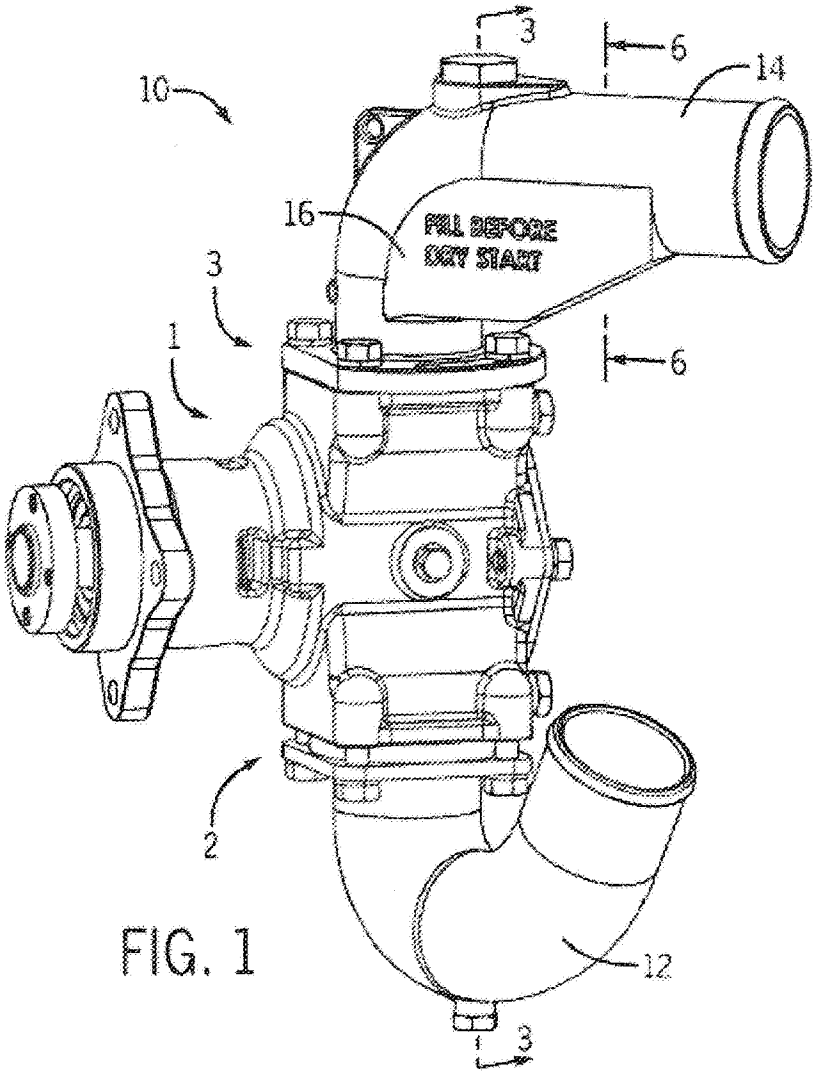
FIG. 1 is a front perspective view of an impeller pump including a porting system according to one embodiment of the invention.

FIG. 1 illustrates an impeller pump 1 including a porting system 10 according to one embodiment of the invention. The impeller pump can include an inlet port 2 and an outlet port 3. The porting system 10 can include an inlet tube 12, an outlet tube 14, and a reservoir 16. The inlet tube 12 can be in fluid communication with the inlet port 2. The outlet tube 14 can be in fluid communication with the outlet port 3. The impeller pump 1 can provide suction to draw fluid through the inlet tube 12 and can discharge the fluid through the outlet tube 14. In some embodiments, the inlet tube 12 and/or the outlet tube 14 can be curved. In some embodiments, the outlet tube 14 can be elbow-shaped. In some embodiments, the reservoir 16 can be coupled to the outlet tube 14 while in other embodiments, the reservoir 16 can be coupled to the inlet tube 12.

As shown in FIG. 2, the reservoir 16 can include a first chamber 18 and a second chamber 20. The first chamber 18 and the second chamber 20 can be in fluid communication. In some embodiments, the second chamber 20 can include an upper end 22, a lower end 24, and a ridge 26. The ridge 26 can connect the upper end 22 and the lower end 24. In some embodiments, the upper end 22 can be rounded. The reservoir 16 can be located between a first position 28 on the outlet tube 14 and a second position 30 on the outlet tube 14. In some embodiments, the lower end 24 can be located at the second position 30. In some embodiments, the second position 30 can be upstream of the first position 28.

Figure 3:
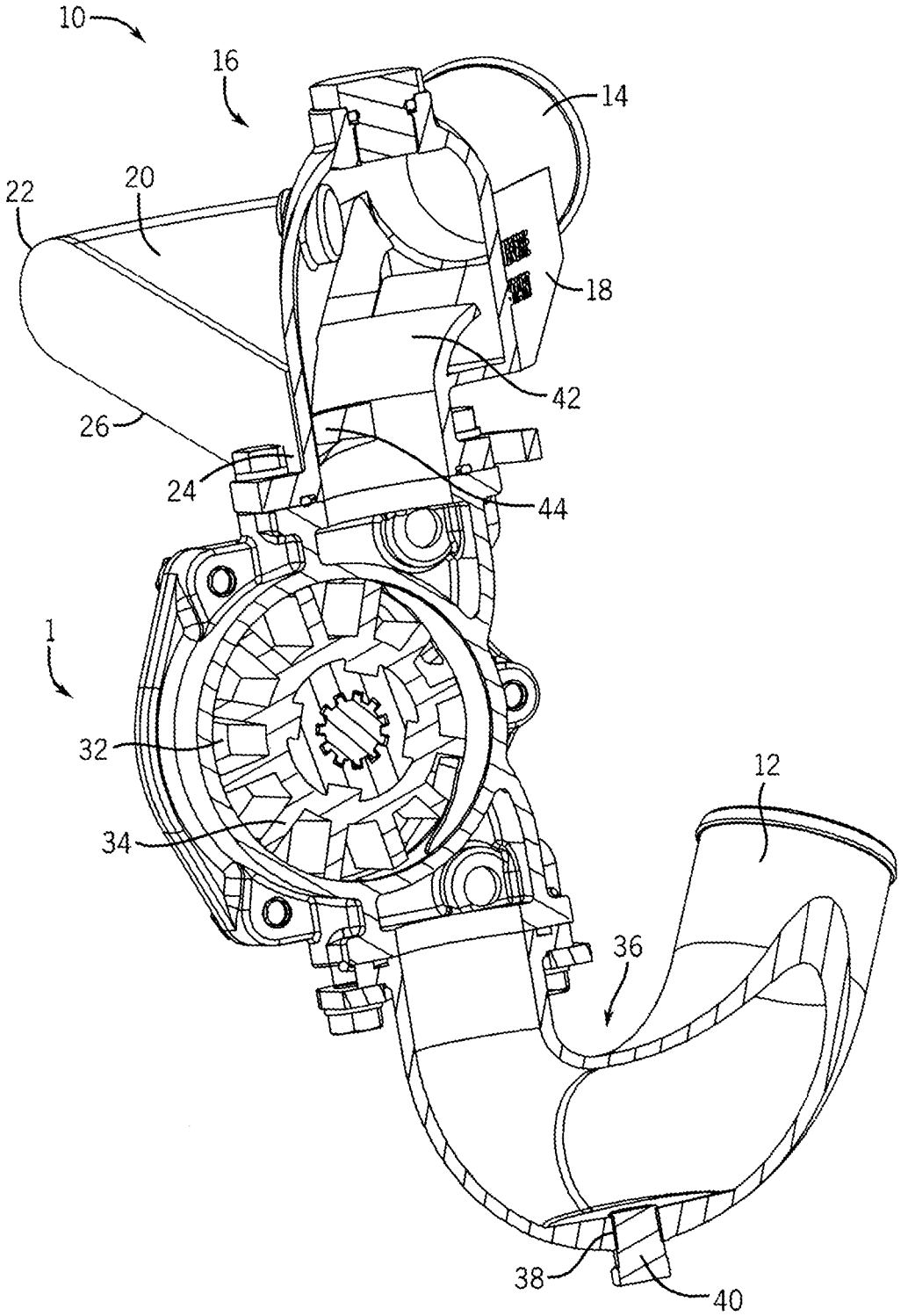
FIG. 3 is a cross-sectional view of the impeller pump of FIG. 1.

FIG. 3 illustrates the internal components of the impeller pump 1 and the porting system 10. The impeller pump 1 can include a pumping chamber 32 and an impeller 34. The impeller 34 can rotate within the pumping chamber 32 in order to draw the fluid through the inlet tube 12. In some embodiments, the inlet tube 12 can include a trap 36 and a drain 38. In some embodiments, the trap 36 can be U-shaped. In other embodiments, the trap 36 can be P-shaped. The drain 38 can be normally closed with a plug 40. If the impeller pump 1 is not running, the trap 36 can hold a certain amount of fluid.

The fluid coming from the inlet tube 12 can pass the pumping chamber 32 and can flow into the outlet tube 14. The fluid exiting the pumping chamber 32 can flow over a partial port wall 42. The partial port wall 42 can guide at least part of the fluid exiting the pumping chamber 32 into the reservoir 16. In some embodiments, the partial port wall 42 can be curved. In some embodiments, the partial port wail 42 can reduce turbulence generation within the fluid in the reservoir 16.

In some embodiments, the first chamber 18 can be in fluid communication with the outlet tube 14. The partial port wall 42 can direct some of the fluid exiting the pumping chamber 32 into the first chamber 18. In some embodiments, the first chamber 18 and/or the partial port wall 42 can direct fluid flow toward the second chamber 20. The second chamber 20 can collect the fluid being directed by the partial port wall 42 and/or the fluid being collected by the first chamber 18. In some embodiments, the volume of the reservoir can be related to the volume of the trap 36. In some embodiments, the reservoir 16 can hold enough fluid to substantially fill the trap 36.

In some embodiments, the reservoir 16 can include an outlet 44. In some embodiments, the outlet 44 can be in fluid communication with the second chamber 20 and the outlet pipe 14. In some embodiments, the outlet 44 can be positioned upstream of the partial port wall 42. The outlet 44 can be designed so that substantially no fluid can enter the reservoir 16 through the outlet 44.

During normal operation, the impeller pump 1 can draw the fluid from the inlet tube 12 through the pumping chamber 32 into the outlet tube 14. The partial port wall 42 can divide the fluid flow so that at least part of the fluid can be collected by the reservoir 16, while the uncollected fluid can continue to flow through the outlet tube 14. The reservoir 16 can store a certain amount of the collected fluid. In some embodiments, the amount being stored within the reservoir 16 can substantially fill the trap 36 of the inlet tube 12. The reservoir 16 can be designed to hold the fluid under various operating conditions of the impeller pump 1, such as, for example, varying/multiple flow rates, varying/multiple pressures, etc. The pressure inside the outlet tube 14 can allow storage of fluid within the reservoir 16. In one embodiment, the amount of fluid that can be stored in the reservoir 16 and the trap 36 can be about 14 fluid ounces. Even with little or no fluid coming from the inlet tube 12, the fluid stored in the reservoir 16 can allow the impeller pump 1 to operate for about 30 minutes, while preventing any severe damage to the impeller pump 1 and/or reducing the efficiency of the impeller pump 1.

If the amount of fluid collected by the partial port wall 42 exceeds the amount that can be stored in the reservoir 16, the outlet 44 can return excess fluid to the outlet tube 14. In some embodiments, the fluid exiting the outlet 44 can flow over the partial port wall 42 so that some of the fluid can circulate in the reservoir 16.

In some embodiments, shutting down the impeller pump 1 can result in the stored fluid exiting the reservoir 16 through the outlet 44. The fluid can flow through the pumping chamber 32 into the inlet tube 12. The trap 36 can hold the fluid until the impeller pump 1 starts operating again. As a result, the impeller pump 1 can be supplied with fluid even with little or no fluid coming from the trap 36 and the inlet tube 12.

Figure 4:
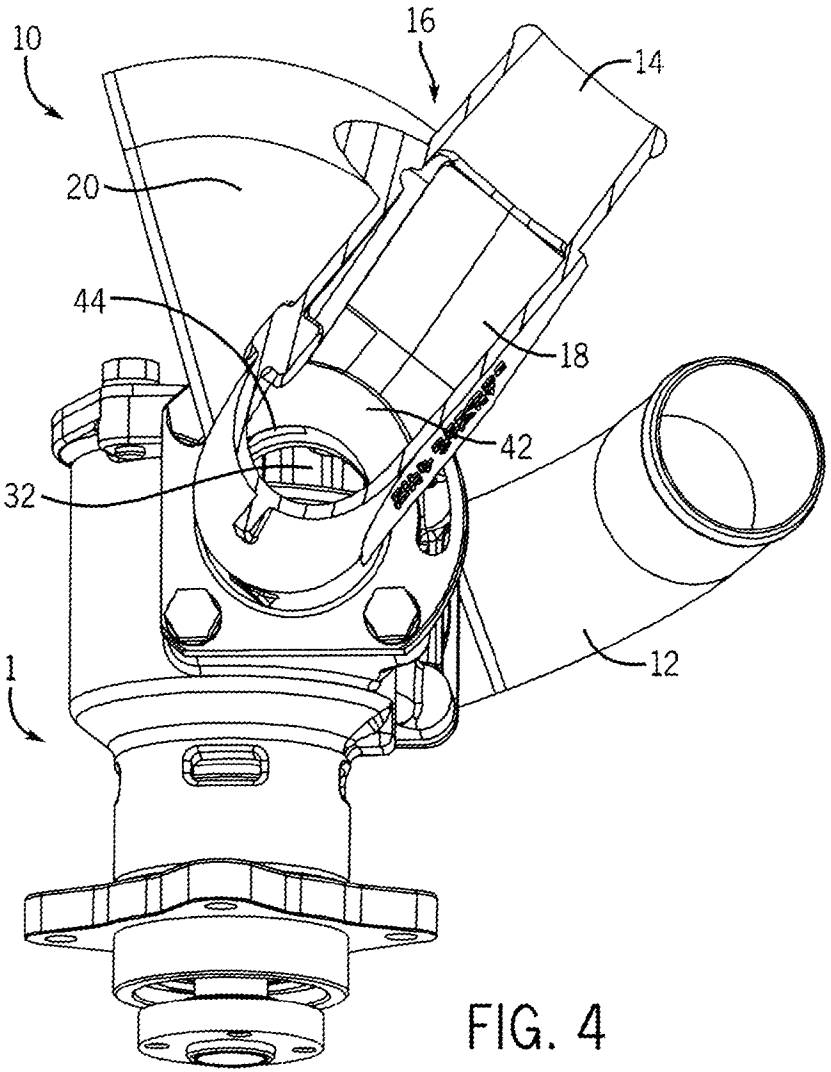
FIG. 4 is a cross-sectional view of the porting system taken along line 4-4 of FIG. 2.

FIG. 4 illustrates a cross-sectional view of the porting system 10. In some embodiments, the first chamber 18 can be positioned below the outlet tube 14 and the second chamber 20 can extend to one side of the outlet tube 14. The second chamber 20 can also be located in other suitable positions. In some embodiments, the location of the reservoir 16 can be dictated by considerations such as space restrictions in the vicinity of the porting system 10 and/or the impeller pump 1.

Figure 5B:
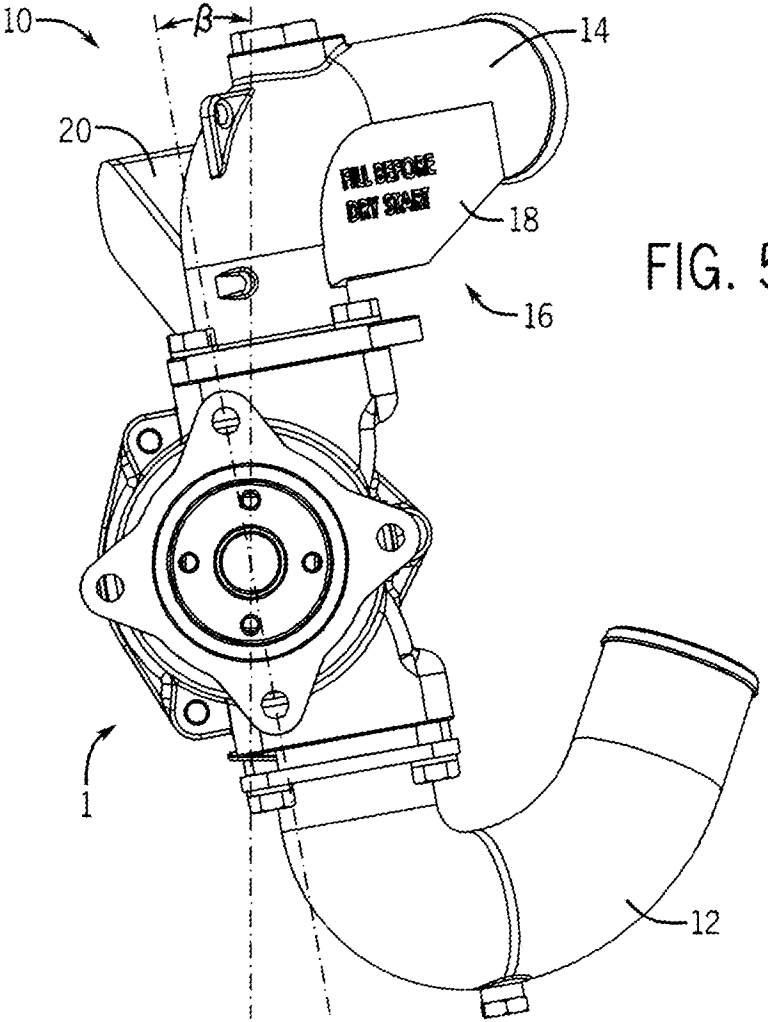
FIGS. 5A and 5B are a front perspective view and a side perspective view of the impeller pump of FIG. 1, illustrating a pitch angle and a skew angle, respectively.
Figure 5A:
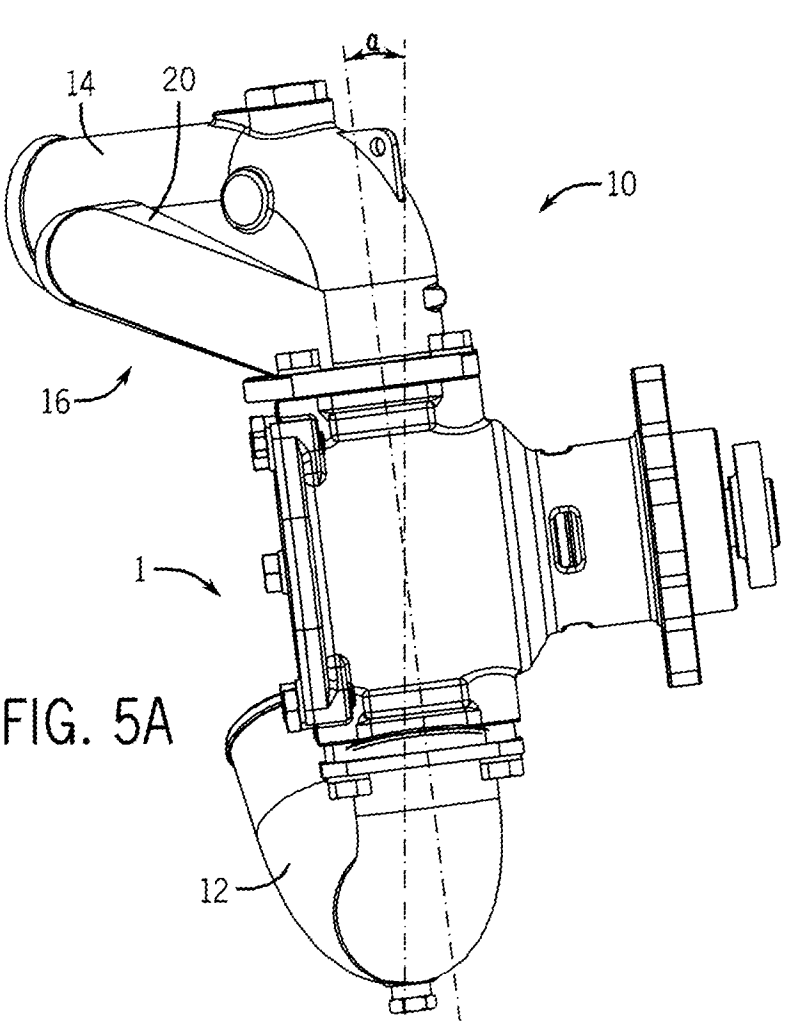

In some embodiments, the porting system 10 can be operational at an angle of incident. FIGS. 5A and 5B illustrate a pitch angle $\alpha$ and a skew angle $\beta$. The porting system 10 can operate even with non-zero pitch angles $\alpha$ and/or skew angles $\beta$. In some embodiments, the pitch angle and/or the skew angle and range from about −30 degrees to about +30 degrees without affecting the efficiency of the impeller pump 1 and/or the porting system 10.

Figure 6:
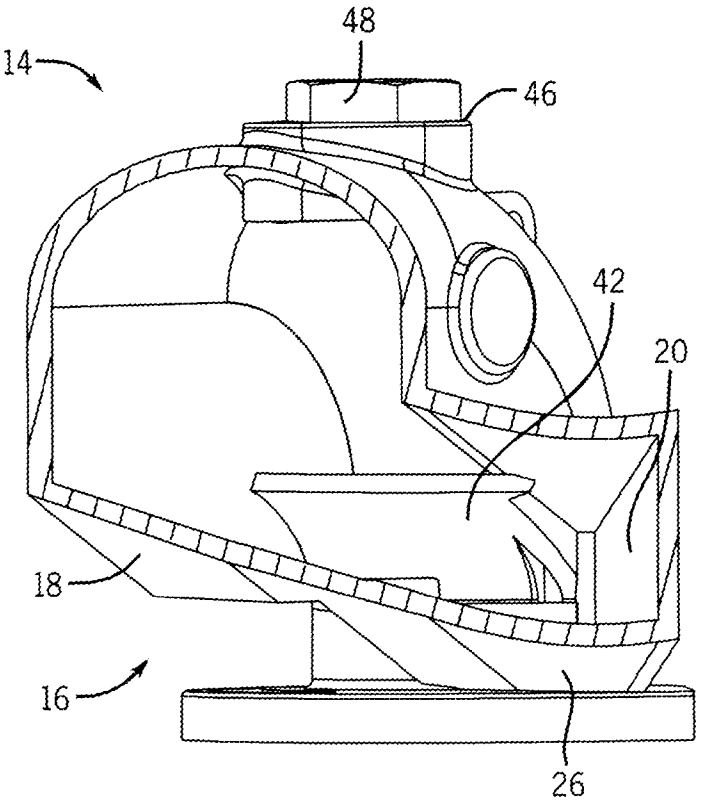
FIG. 6 is a second cross-sectional view of an outlet tube of the porting system taken along line 6-6 of FIG. 1.

FIG. 6 illustrates a cross-sectional view of the outlet tube 14. In some embodiments, the outlet tube 14 can include a fill hole 46. The fill hole 46 can be in fluid communication with the reservoir 16. In some embodiments, the fill hole 46 can be positioned above the first chamber 18. The fill hole 46 can be closed with a removable plug 48. The fill hole 46 can enable manual priming of the porting system 10. If the impeller pump 1 is being installed for the first time, if the impeller pump 1 is being repaired, or if the fluid in the porting system 10 has evaporated due to downtime of the impeller pump 1, the fill hole 46 can be used to fill the reservoir 16 with fluid.

Other types of suitable impeller pumps can be used other than those shown and described with respect to FIGS. 1-6. Rather than impeller pumps, other suitable pumps can include pumps that are cooled by a fluid stream being directed into the pumping chamber. In some embodiments, the impeller pump 1 can be used in marine applications. For example, the impeller pump 1 can provide a stream of water to an engine of a boat. The inlet tube 12 can be supplied with water from outside the boat. If the inlet tube 12 becomes clogged and/or the boat's engine is started outside a body of water, the flow through the inlet tube 12 may be insufficient. In these situations, the porting system 10 can provide an extended period of operation by providing dry-run protection for the impeller pump 1 even with little to no fluid flow coming from the inlet tube 12.

During dry-run operations, the flow rate through the inlet tube 12 can drop below a minimal flow rate necessary for normal operation. During dry-run operations, the reservoir 16 can release the stored fluid through the outlet 44. The fluid coming from the outlet 44 can flow into the pumping chamber 32, where the fluid can cool the impeller 34 and/or lubricate a connection between the pumping chamber 32 and the impeller 34. The impeller 34 can propel the fluid out of the pumping chamber 32 back into the outlet tube 14. The partial port wall 42 can collect at least part of the returned fluid into the first chamber 18 from which the collected fluid can flow into the second chamber 20. The ridge 26 can promote a flow of the collected fluid toward the outlet 44. A new cycle of fluid flow can then start over again. In some embodiments, the collected fluid can decrease during the dry run operation. In some embodiments, a ratio of the fluid collected by the reservoir over the total flow rate through the outlet tube 14 upstream of the partial port wall 42 can be inversely proportional to the total flow rate. In some embodiments, a percentage of collected fluid for a high flow rate can be smaller than a percentage of collected fluid for a low flow rate.

Figure 7:
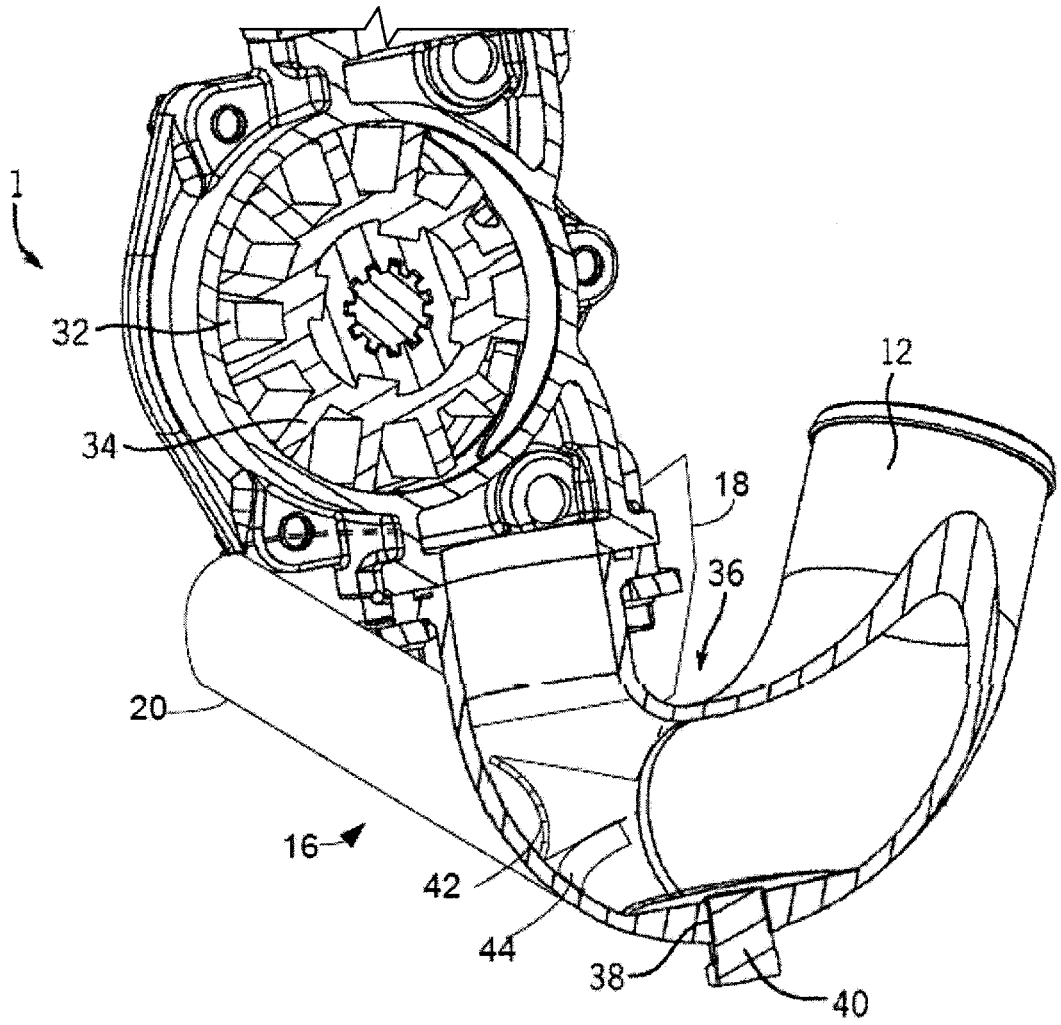
FIG. 7 is a cross-sectional view of an impeller pump according to an alternative embodiment of the present invention.

In alternative embodiments, as illustrated in FIG. 7, the reservoir 16 can be coupled to the inlet tube 12 and the outlet 44 can be in fluid communication with the trap 36. The partial port wall 42 can be positioned inside the inlet tube 12 downstream of the trap 36. As a result, the reservoir 16 can direct fluid by suction toward the pumping chamber 32 and the impeller 34 during dry-run operations.

Typical marine raw water cooling pumps do not have to run dry for significant periods of time. The pump is free to draw water from the boats cooling water intake and the pump primes very quickly. There are certain applications where it would be beneficial to start the propulsion engine before the boat is lowered into the water. An example of this application would be a life boat where the propulsion engine may be started while the passengers board the vessel. The conventional method of dealing with an extended dry run is to focus on the impeller material and design reducing the friction created by the impeller and using a material that better manages dry run. However, the impeller materials do not perform as well as a typical standard impeller compound, the cover plate and other components can become very hot during the cycle, and it is very hard on mechanical seal components.

Some embodiments of the invention provide a solution to this problem by providing a porting system 10 that allows the operator to prime the pump 1 with a small amount of water which is trapped within the pump 1 during the dry-run cycle. The porting system 10 includes a fill hole 46 on an expanded outlet tube 14 and a trap 36 on the inlet tube 12. The outlet tube 14 volume is expanded to prevent water from escaping through the outlet port 3 which then re-circulates through the pump 1. The inlet tube 12 includes the trap 36 to hold water should the startup routine be interrupted.

Some embodiments of the invention provide a looped inlet and outlet design on a rubber impeller pump 1 to maintain a certain volume of fluid in the pump 1 at shut down. If the pump were to be run dry after the initial filling, the volume that is captured during the previous shutdown is enough to prevent impeller and seal damage to the pump for up over 30 minutes. The pump 1 can be filled initially or ran with water to initially fill the pump and piping. The inlet tube 12 is angled to loop the hose over the centerline of the pump 1 (or just enough to form a suction trap) in order to create a water trap 36 and maintain a certain volume of water in the pump 1 at shutdown. The outlet tube 14 is designed with a minimum volume so water can be trapped in the reservoir 16 upon a dry start-up. When the pump 1 is run without water, the pump 1 starts to force the fluid out of the outlet tube 14. A certain amount of fluid splashes back into the reservoir 16 and the fluid collects in the trap 36 and the reservoir 16 until the self-priming rubber impeller pump 1 can collect enough fluid to create another jet of water toward the outlet port 3. This process repeats itself as the same water is essentially gurgled in the pump housing. At idle speed, this amount of water is enough to keep the impeller 34 and seal cooled and lubricated over 30 minutes.

Some embodiments of the invention provide a modified outlet tube 14 to hold additional volume to enhance the dry-run capabilities described above. Situations in which the porting of the pump 1 is fixed or the pump 1 is angled in such a way that the fluid would escape the outlet port 3 dictate that internal features within the outlet tube 14 should be created to be able to hold the minimum amount of fluid for cooling described above, as well as drain the fluid back to the pumping chamber 32 via internal passages during the dry run cycle. Additionally, the outlet tube 14 is constructed with a partial port wall 42 in front of the reservoir 16 to allow for more laminar fluid flow. This feature reduces turbulence and increases the performance of the pump 1 by reducing the overall restriction while maintaining the dry run capability of the pump 1. The filling of the pump 1 is conducted through a fill hole 46 on the outlet port 3, but alternatively, the inlet port 2 could be used for the initial fill. In other embodiments, the pump 1 can be filled through the inlet port 2 and can hold additional fluid while maintaining the fluid dynamics of a traditional port.

The inlet port 2 or the outlet port 3 is filled with a minimum volume of fluid for cooling. The inlet port 2 or the outlet port 3 are designed with extra volume to be able to accommodate this amount. This reservoir 16 is behind a partial port wall 42 that deflects the discharged fluid away from the reservoir 16 and into the outlet tube 14 during normal pump operation. If this partial port wall 42 were not in place, water would impinge on the reservoir 16 and create turbulence within the pump 1, which increases the overall restriction of the outlet port 14. If the pump 1 were angled in such a way that the fluid would exit the outlet port 3 during the dry run cycle described above, an internal passage allows the fluid to run down the channel and back into the pumping chamber 32 as originally intended. An inlet port 2 in a similar design can include the additional volume and partial port wall 42, but may or may not need the internal passage to function properly.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A pump comprising:

an inlet port;

an outlet port;

a pumping chamber positioned between the inlet port and the outlet port;

a porting system including an inlet tube in fluid communication with the inlet port, the inlet tube including a trap in which a first volume of fluid can be collected;

an outlet tube in communication with the outlet port, and a reservoir in fluid communication with the pumping chamber, the reservoir including a first chamber and a second chamber separated by a partial port wall, the first chamber being in fluid communication with the outlet tube, the second chamber extending outwardly from the outlet tube, and receiving fluid directed over the partial port wall from the pumping chamber, the reservoir collecting a second volume of fluid substantially equal to the first volume of fluid collected by the trap, the reservoir including an outlet that returns excess fluid to the pumping chamber;

the first volume of fluid and second volume of fluid providing enough fluid trapped inside the pump to allow the pump to temporarily operate when substantially no fluid is flowing into the inlet port.

2. The pump of claim 1 wherein the pump can operate for up to 30 minutes when substantially no fluid is flowing into the inlet port.

3. The pump of claim 1 wherein the pump is an impeller pump housing an impeller in the pumping chamber.

4. The pump of claim 3 wherein the impeller is cooled and lubricated for up to about 30 minutes at idle speed.

5. The pump of claim 3 wherein the impeller is constructed of rubber.

6. The pump of claim 1 wherein the outlet tube is elbow-shaped.

7. The pump of claim 1 wherein the trap is U-shaped.

8. The pump of claim 1 wherein the partial port wall reduces turbulence in the reservoir.

9. The pump of claim 1 wherein the pump is used in marine applications.

10. The pump of claim 1 wherein the partial port wall divides the fluid and directs a first portion of the fluid into the first chamber and a second portion of the fluid into the second chamber.

11. The pump of claim 1 wherein the outlet tube includes a fill hole with a removable plug for use in priming the pump.

12. The pump of claim 1 wherein the outlet tube includes a fill hole with a removable plug.

13. A pump comprising:

an inlet port;

an outlet port;

a pumping chamber positioned between the inlet port and the outlet port; and a porting system including an inlet tube in fluid communication with the inlet port, the inlet tube including a reservoir, the reservoir including a first chamber and a second chamber separated by a partial port wall, the first chamber providing fluid to tile pumping chamber, the second chamber, extending outwardly from the inlet tube, and receiving fluid directed over the partial port wall from the inlet port, the second chamber collecting a volume of fluid in order to provide enough fluid trapped inside the pump to allow the pump to temporarily operate when substantially no fluid is flowing into the inlet port.

14. The pump of claim 13 wherein the pump can operate for up to 30 minutes when substantially no fluid is flowing into the inlet port.

15. The pump of claim 13 wherein the pump is an impeller pump housing an impeller in the pumping chamber.

16. The pump of claim 15 wherein the impeller is cooled and lubricated for up to about 30 minutes at idle speed.

17. The pump of claim 15 wherein the impeller is constructed of rubber.

18. The pump of claim 13 wherein the outlet tube is elbow-shaped.

19. The pump of claim 13 wherein the partial port wall reduces turbulence in the reservoir.

20. The pump of claim 13 wherein the pump is used in marine applications.

21. The pump of claim 13 wherein the partial port wall divides the fluid and directs a first portion of the fluid into the first chamber and a second portion of the fluid into the second chamber.

22. A pump comprising:

an inlet port;

an outlet port:

a pumping chamber positioned between the inlet port and the outlet port;

a porting system including an inlet tube in fluid communication with the inlet port, the inlet tube including a trap in which a first volume of fluid can be collected;

an outlet tube in communication with the outlet port, and a reservoir in fluid communication with the pumping chamber, the reservoir including a first chamber and a second chamber separated by a partial port wall, the first chamber being in fluid communication with the outlet tube, the second chamber receiving fluid directed over the partial port wall from the pumping chamber, the reservoir collecting a second volume of fluid substantially equal to the first volume of fluid collected by the trap, the reservoir including an outlet that returns excess fluid to the pumping chamber;

the first volume of fluid and second volume of fluid providing enough fluid trapped inside the pump to allow the pump to temporarily operate when substantially no fluid is flowing into the inlet port;

wherein the pump operates efficiently at one of a pitch angle and a skew angle of about negative 30 degrees to about positive 30 degrees.

23. A pump comprising:

an inlet port;

an outlet port;

a pumping chamber positioned between the inlet port and the outlet port; and a porting system including an inlet tube in fluid communication with the inlet port, the inlet tube including a reservoir, the reservoir including a first chamber and a second chamber separated by a partial port wall, the first chamber providing fluid to the pumping chamber, the second chamber receiving fluid directed over the partial port wall from the inlet port, the second chamber collecting a volume of fluid in order to provide enough fluid trapped inside the pump to allow the pump to temporarily operate when substantially no fluid is flowing into the inlet port;

wherein the pump operates efficiently at one of a pitch angle and a skew angle of about negative 30 degrees to about positive 30 degrees.

* * * * *